US006477745B2

(12) United States Patent
Strebl

(10) Patent No.: US 6,477,745 B2
(45) Date of Patent: Nov. 12, 2002

(54) CLIP FOR A BALL-THROWING DEVICE

(76) Inventor: Stephan Erich Hills Strebl, 102 Van Tassel Ct., San Anselmo, CA (US) 94901

( * ) Notice: Subject to any disclaimer, the term of this patent is extended or adjusted under 35 U.S.C. 154(b) by 0 days.

(21) Appl. No.: 09/751,919

(22) Filed: Dec. 26, 2000

(65) Prior Publication Data

US 2002/0078533 A1 Jun. 27, 2002

(51) Int. Cl.[7] ..... A44B 21/00
(52) U.S. Cl. ..... 24/3.12; 24/336; 24/11 R; 24/3.3
(58) Field of Search ..... 24/3.12, 11 R, 24/10 R, 336; 401/131; 211/69.1

(56) References Cited

U.S. PATENT DOCUMENTS 463,351 A * 11/1891 Elliott ..... 24/11 R X
922,279 A * 5/1909 Heidingsfeld et al. .... 24/336 X
1,762,793 A * 6/1930 Oxx ..... 24/11 R
1,863,016 A * 6/1932 Krause ..... 24/11 R
1,997,025 A * 4/1935 Waechtler ..... 24/11 R X
5,235,727 A * 8/1993 McCloskey ..... 24/3.3

* cited by examiner

*Primary Examiner*—Robert J. Sandy
(74) *Attorney, Agent, or Firm*—Risto A Rinne, Jr.

(57) ABSTRACT

An apparatus for use with a ball throwing device includes a main body and an arcuate portion that extends from the main body. The apparatus is adapted to be attached to a shaft of the ball throwing device and the arcuate portion is adapted to be placed over an article of clothing, the article of clothing being disposed intermediate the arcuate portion and the shaft of the device. The main body is adapted for placement over the shaft at a lower portion of the shaft and to be urged up the shaft toward the handle until it reaches the beginning of the handle where the apparatus is retained in position to the device by a pair of dimples that are formed in the main body.

5 Claims, 1 Drawing Sheet

CLIP FOR A BALL-THROWING DEVICE

BACKGROUND OF THE INVENTION

1. Field of the Invention

The present invention, in general relates to devices used to toss a tennis ball for an animal to fetch and, more particularly, to clips that secure such kinds of devices to the belt of a user.

Dog owners have long known how dogs love to play with tennis balls. They are easy for a dog to pick up off of the ground and to carry in its mouth.

However, when a tennis ball is returned (i.e., fetched by the dog) and the dog owner picks up the ball to toss it again, it often is wet from saliva in the dog's mouth. This is unpleasant.

Also, there is a desire for dog owners to be able to throw a tennis ball even further away but this is difficult to accomplish do to the light weight of the tennis ball.

To satisfy these needs devices have been created to aid in picking up the tennis ball and in throwing it. One such type of device is called a "CHUCKIT" and is manufactured by "Canine Hardware Inc.". This company has a website at "WWW.CHUCKIT.COM".

This device well satisfies the above problems yet it itself is long, resembling a curved stick having a handle at one end and a scoop for holding a tennis ball at the remaining end.

The user must presently carry this device with him. No method is provided of attaching it to the user.

In order to provide a device that can aid in carrying the "CHUCKIT", several problems must be overcome.

First, as the device is used, it is whipped at high speed. Therefore, any clip that is attached thereto must be retained in position.

Second, as the device is used, its shaft flexes. Therefore, any clip that is attached thereto must not substantially interfere with the ability of the device to properly function.

Third, as the device is used, it must be available for instant use. Therefore, any clip that is attached thereto must secure the device to the user quickly and easily and it must also provide a way for the user to remove the device from such securement equally as fast.

Fourth, as the device itself is inexpensive, it is not realistic to expect the user to pay a great deal for a clip to attach the device to the user. Accordingly, the clip must be both inexpensive and easy to manufacture so that it can be inexpensively offered for sale.

Accordingly there exists today a need for a clip that can quickly and easily allow a user of a CHUCKIT to attach the device to the user and remove it for instant use as desired.

Clearly, such an apparatus is both useful and desirable.

2. Description of Prior Art

Clips are, in general, known. However, while the structural arrangements of the above known types of devices, at first appearance, may have similarities with the present invention, they differ in material respects. These differences, which will be described in more detail hereinafter, are essential for the effective use of the invention and which admit of the advantages that are not available with the prior devices.

OBJECTS AND SUGARY OF THE INVENTION

It is an object of the present invention to provide a clip for a ball-throwing device that is inexpensive to manufacture.

It is also an important object of the invention to provide a clip for a ball-throwing device that is easy to manufacture.

Another object of the invention is to provide a clip for a ball-throwing device that is inexpensive to purchase.

Still another object of the invention is to provide a clip for a ball-throwing device that is detachably-attachable with respect to a CHUCKIT.

Still yet another object of the invention is to provide a clip for a ball-throwing device that includes a method useful in retaining it to the CHUCKIT when the CHUCKIT is being used to toss a tennis ball.

Yet another important object of the invention is to provide a clip for a ball-throwing device that does not interfere with the effective use of the CHUCKIT.

Still yet another important object of the invention is to provide a clip for a ball-throwing device that is easy to attach and remove from an article of clothing worn by a user.

Briefly, a clip for a ball-throwing device that is constructed in accordance with the principles of the present invention has a main body portion that is adapted to match the contour of an upper portion of a shaft of a CHUCKIT. The main body portion includes an opening running along its longitudinal length, the opening being of sufficient width to permit placing the clip over a lower portion of the shaft. The clip is then slid upward along the length of the shaft until its contour begins to match that of the shaft and resistance to its movement begins to increase. An additional urging of the clip along the shaft allows a protrusion on the clip to engage with a recess in the shaft, thereby securing the clip to shaft. An arcuate portion extends from the main body portion of the clip for a predetermined distance. The arcuate portion includes a first segment that is disposed slightly away from the shaft and which then curves back toward the shaft until it makes contact with the shaft at a second segment and then curves away from the shaft and terminates at a third segment thereof. The third segment of the clip is placed over a belt or pocket lip and as the CHUCKIT is urged closer toward the belt or pocket, the clip engages with the belt of pocket to hold the CHUCKIT in place. To use the CHUCKIT, a force is applied in an opposite direction to remove it and the clip that remains attached thereto from the pocket or belt.

DETAILED DESCRIPTION OF THE INVENTION

Figure 1A:
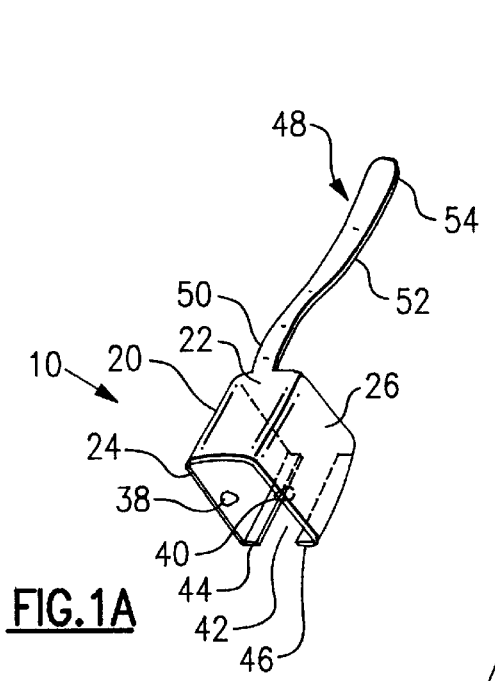
FIG. 1A is a view in perspective of the chip for a ball-throwing device of FIG. 1.
Figure 1:
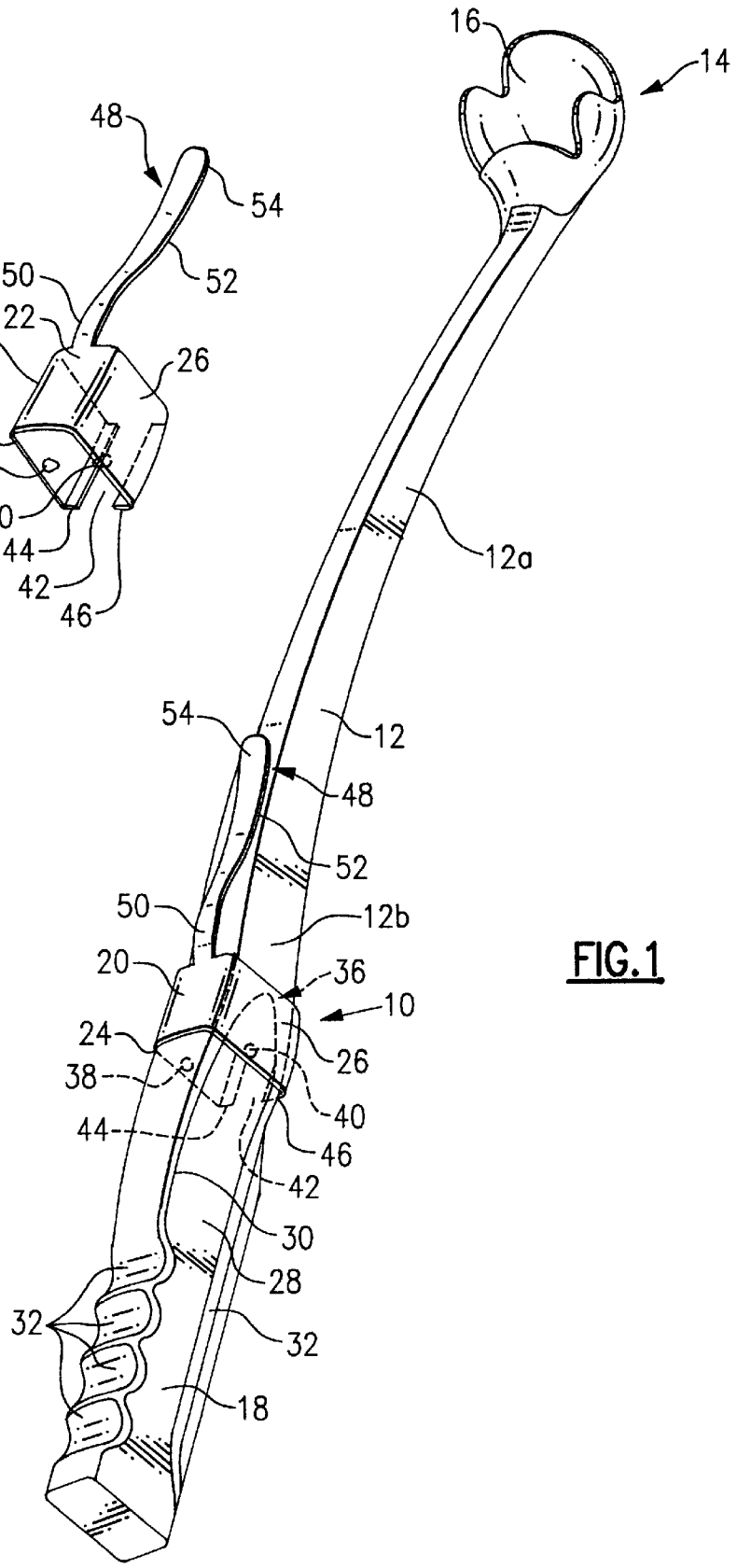
FIG. 1 is a view in perspective of a CHUCKIT and of a clip for a ball-throwing device attached thereto.

Referring to FIG. 1 is shown, a clip for a ball-throwing device, identified in general by the reference numeral 10 is shown in two positions, one position being elevated above a lower portion 12*a* of a shaft 12 of a CHUCKIT (identified in general by the reference numeral 14) and the other position attached to an upper portion 12*b* of the shaft 12.

The CHUCKIT 14 is a device that is used to throw a tennis ball (not shown). It includes a spherical scoop portion 16 attached to the lower portion 12*a* of the shaft 12 and a handle portion 18 that is attached to the upper portion 12*b* of the shaft 12.

In use, the tennis ball is inserted into the scoop 16 and the handle 18 is used to whip the CHUCKIT 14 in a manner that accelerates the tennis ball and impels it away from the CHUCKIT 14. The CHUCKIT 14 may also be used to pick up the tennis ball off of the ground by pressing the scoop 16 against the tennis ball with sufficient force to cause the tennis ball to enter therein.

The clip 10 includes a main body portion 20 that has a top rectangular planar surface 22, and a pair of oppositely disposed side members 24, 26 that are disposed generally in a parallel spaced apart relationship with respect to each other and which are generally in perpendicular planar alignment with respect to the top surface 22.

The top surface 22 and the pair of side members 24, 26 are each somewhat curved, as desired, to optimally match the contours of the CHUCKIT 14 at the upper portion 12*b* of the shaft 12. The curvature of the top surface 22 and of the pair of side members 24, 26 is designed to match the contour of the handle 18 where the handle 18 begins and is attached to the shaft 12.

The handle portion 18 includes an inner planar member 28, a portion of the plane of the inner planar member 28 being disposed in parallel alignment with a longitudinal axis of the shaft 12.

An upper handle lip 30 extends outward from the inner planar member 28 and includes a plurality of curves 32 that are designed to match the fingers (not shown) of the user.

A lower handle lip 34 extends outward from the inner planar member 28 at a side of the planar member 28 that is opposite with respect to where the upper handle lip 30 is attached.

The upper and lower handle lips 30, 34 contact one another at the upper portion 12*b* of the shaft in a "V" shaped area, identified in general by the reference numeral 36 and shown under the main body 20 of the clip 10 in dashed lines.

Each of the pair of side members 24, 26 includes a dimple 38, 40, respectively that is depressed in the pair of side members 24, 26 at a first end thereof. The dimples 38, 40 are formed in the side members 24, 26 near to a centerline that passes through each of the pair of side members 24, 26 and which extends along a longitudinal length of the clip 10.

The dimples 38, 40 are either pressed into (i.e., formed) or molded into the side members 24, 26. They each protrude from the inside plane of each of the side members 24, 26 and are used to retain the clip 10 to the CHUCKIT, as is described in greater detail hereinafter.

The main body 20 of the clip 10 includes an opening 42 running along its longitudinal length, the opening 42 having a width that is sufficient to permit placing the clip over the lower portion 12*a* of the shaft 12.

The lower portion 12*a* of the shaft 12 is narrower (less width) than the upper portion 12*b*.

Therefore, once the main body 20 of the clip 10 is placed over the lower portion 12*a* and is urged (i.e., slid) up along the length of the shaft 12, it is retained therein by a pair of bottom members 44, 46 that are each attached to one of the pair of side members 24, 26 at an end of the pair of side members 24, 26 that is opposite to where the pair of side members 24, 26 are each attached to the top surface 22.

The pair of bottom members 44, 46 are both in substantial parallel planar alignment with respect to the top surface 22.

As the clip 10 is urged toward the handle 18 the dimples 38, 40 eventually pass the "V" area 36 after which they each extend into the space that is provided intermediate the upper and lower handle lips 30, 32 and the planar member 28.

Accordingly, the dimples 38, 40 resist sliding (i.e., urging) of the clip 10 back down the shaft 12 toward the lower portion 12*a*. When the CHUCKIT 14 is used the throw the tennis ball, the dimples 38, 40 help to retain the clip 10 in position and prevent it from dislodging.

If it is desired to remove the clip 10 from the CHUCKIT 14, a sufficient force is applied to the clip 10 to urge the dimples 38, 40 to pass over the "V" shaped area 36 and allow the clip 10 to slide back down along the longitudinal length of the shaft 12 toward the lower portion 12*a* where it can be removed apart from the CHUCKIT 14 by lifting it off of the shaft 12 which is then able to pass through the opening 42.

This permits saving the clip 10 which does not experience substantial wear and of reusing the clip 10 with other CHUCKITS (not shown), as desired.

A arcuate portion, identified in general by the reference numeral 48, is attached to the main body 20 at an opposite end of the main body 20 with respect to where the dimples 38, 40 are generally disposed.

The arcuate portion 48 generally extends along the longitudinal length of the clip 10 (and of the shaft 12 when the clip 10 is attached to the CHUCKIT 14). The arcuate portion 48 includes a first segment 50, a second segment 52, and a third segment 54.

The first segment 50 begins at the main body 20 and extends generally away from it. The first segment 50 is disposed slightly away from the shaft 12 and it curves back toward the shaft 12 where it joins the second segment 52 which then itself makes contact with the shaft 12. The third segment 54 is attached to the second segment 52 and it continues to curve away from the main body 20 until it eventually terminates.

The third segment 54 of the clip 10 is adapted for placement over a belt (not shown) or a pocket lip (not shown) or a shirt (not shown), jacket (not shown), pair of pants (not shown) or other article of clothing.

The CHUCKIT 14 is then urged closer toward the belt, pocket, or other article of clothing until the clip 14 engages with the article of clothing sufficient to secure the CHUCKIT to the article of clothing by pinching the article of clothing intermediate the arcuate portion 20 (i.e., in particular, the second segment 52 pinches the article of clothing) and the shaft 12.

To remove the clip 10 from the article of clothing, a sufficient force is applied to urge the CHUCKIT 14 away from the article of clothing. Once removed, the CHUCKIT 14 is ready for use to throw the tennis ball again, after which it is once again attached to the article of clothing until it is again needed to throw the tennis ball.

Of course, the clip 10 may be formed from any desired material including plastics, metals, and synthetic or composite types of materials, as desired.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A clip for a ball-throwing device, comprising:

(a) means adapted for detachably-attaching said clip to said ball throwing device;

(b) means adapted for retaining said clip to said ball throwing device; and (c) means adapted for fastening said clip to an article of clothing;

and wherein said means adapted for detachably-attaching said clip to said ball throwing device includes a main body, said main body including a top rectangular planar surface and a pair of oppositely disposed side members that are disposed generally in a parallel spaced apart relationship with respect to each other and which are generally in perpendicular planar alignment with respect to the top surface and including a pair of bottom members that are each attached to one of the pair of side members at an end of the pair of side members that is opposite to where each the pair of side members are attached to the top surface and wherein the pair of bottom members are both in substantial parallel planar alignment with respect to the top surface and wherein an opening is provided intermediate an inside edge of each of the pair of bottom members that extends along a longitudinal length of the main body and which includes a width that is sufficient to permit the opening to pass over a lower portion of the shaft and which is sufficient to prevent the opening from passing over an upper portion of the shaft;

and wherein said means adapted for retaining said clip to said ball throwing device includes a first dimple formed in one of said pair of side members, said first dimple adapted to protrude into an area provided in said ball throwing device sufficient to retain said clip thereto.

2. The clip for a ball-throwing device of claim 1 wherein said means adapted for retaining said clip to said ball throwing device includes a second dimple formed in a remaining one of said pair of side members, said second dimple adapted to protrude into an area provided in said ball throwing device sufficient to retain said clip thereto.

3. The clip for a ball-throwing device of claim 1 wherein said means adapted for fastening said clip to an article of clothing includes an arcuate portion that is attached to the main body and which extends therefrom a predetermined distance, said arcuate portion being adapted to receive a portion of an article of clothing intermediate said arcuate portion and said shaft when said clip is attached to said ball throwing device.

4. A clip for a ball-throwing device, comprising:

(a) means adapted for detachably-attaching said clip to said ball throwing device;

(b) means adapted for retaining said clip to said ball throwing device; and (c) means adapted for fastening said clip to an article of clothing;

wherein said means adapted for detachably-attaching said clip to said ball throwing device includes a main body, said main body including a top rectangular planar surface and a pair of oppositely disposed side members that are disposed generally in a parallel spaced apart relationship with respect to each other and which are generally in perpendicular planar alignment with respect to the top surface and including a pair of bottom members that are each attached to one of the pair of side members at an end of the pair of side members that is opposite to where each the pair of side members are attached to the top surface;

and wherein the pair of bottom members are both in substantial parallel planar alignment with respect to the top surface;

and wherein an opening is provided intermediate an inside edge of each of the pair of bottom members that extends along a longitudinal length of the main body and which includes a width that is sufficient to permit the opening to pass over a lower portion of the shaft and which is sufficient to prevent the opening from passing over an upper portion of the shaft;

and wherein said means adapted for fastening said clip to an article of clothing includes an arcuate portion that is attached to the main body and which extends therefrom a predetermined distance, said arcuate portion being adapted to receive a portion of an article of clothing intermediate said arcuate portion and said shaft when said clip is attached to said ball throwing device;

and wherein said means adapted for retaining said clip to said ball throwing device includes a first dimple formed in one of said pair of side members, said first dimple adapted to protrude into an area provided in said ball throwing device sufficient to retain said clip thereto;

and wherein said means adapted for retaining said clip to said ball throwing device includes a second dimple formed in a remaining one of said pair of side members, said second dimple adapted to protrude into an area provided in said ball throwing device sufficient to retain said clip thereto.

5. A clip for a ball-throwing device, comprising:

(a) means adapted for detachably-attaching said clip to said ball throwing device;

(b) means adapted for retaining said clip to said ball throwing device; and (c) means adapted for fastening said clip to an article of clothing;

wherein said means adapted for detachably-attaching said clip to said ball throwing device includes a main body, said main body including a top rectangular planar surface and a pair of oppositely disposed side members that are disposed generally in a parallel spaced apart relationship with respect to each other and which are generally in perpendicular planar alignment with respect to the top surface and including a pair of bottom members that are each attached to one of the pair of side members at an end of the pair of side members that is opposite to where each the pair of side members are attached to the top surface;

and wherein the pair of bottom members are both in substantial parallel planar alignment with respect to the top surface;

and wherein an opening is provided intermediate an inside edge of each of the pair of bottom members that extends along a longitudinal length of the main body and which includes a width that is sufficient to permit the opening to pass over a lower portion of the shaft and which is sufficient to prevent the opening from passing over an upper portion of the shaft;

and wherein said means adapted for fastening said clip to an article of clothing includes an arcuate portion that is attached to the main body and which extends therefrom a predetermined distance, said arcuate portion being adapted to receive a portion of an article of clothing intermediate said arcuate portion and said shaft when said clip is attached to said ball throwing device;

and wherein said means adapted for retaining said clip to said ball throwing device includes a first spherical engagement means formed in one of said pair of side members, said first spherical engagement means adapted to protrude into an area provided in said ball throwing device sufficient to retain said clip thereto.

* * * * *